US005263395A

United States Patent [19]

Phillips

[11] Patent Number: 5,263,395

[45] Date of Patent: Nov. 23, 1993

[54] DRUMSTICKS

[76] Inventor: Kristan B. Phillips, 21st Floor, Universal Tower, Block B, Flat B2, 18-26 Kin Wah Street, North Point, Hong Kong

[21] Appl. No.: 956,471

[22] Filed: Oct. 2, 1992

Related U.S. Application Data

[63] Continuation of Ser. No. 598,827, Oct. 19, 1990, abandoned, which is a continuation of Ser. No. 304,433, Jan. 23, 1989, abandoned.

[30] Foreign Application Priority Data

Jul. 21, 1986 [GB] United Kingdom ..... 8617746

[51] Int. Cl.[5] ..... G10D 13/02

[52] U.S. Cl. ..... 84/422.4

[58] Field of Search ..... 84/422.1, 422.2, 422.3, 84/422.4

[56] References Cited

U.S. PATENT DOCUMENTS

| | | | |
|---|---|---|---|
| D. 281,785 | 12/1985 | Balter et al. | 84/422.4 |
| 1,892,416 | 12/1932 | Vitto | 84/422.4 |
| 1,953,619 | 4/1934 | Ludwig | 84/422.4 |
| 2,466,554 | 4/1949 | Mossey | 84/422.4 |
| 2,586,163 | 2/1952 | Heiderich et al. | 84/422.4 |
| 2,853,912 | 9/1958 | Gladstone | 84/422.4 |
| 3,411,395 | 11/1968 | Hanes | 84/422.4 |
| 3,893,364 | 7/1975 | Harrison | 84/422.4 |
| 4,114,503 | 9/1978 | Petillo | 84/422.4 |
| 4,386,549 | 6/1983 | Shinneman | 84/422.4 |
| 4,640,177 | 2/1987 | Elliott | 84/422.4 |

FOREIGN PATENT DOCUMENTS

| | | | |
|---|---|---|---|
| 1020750 | 2/1966 | United Kingdom | 84/422.4 |

*Primary Examiner*—Michael L. Gellner
*Assistant Examiner*—Cassandra Spyrou
*Attorney, Agent, or Firm*—Finnegan, Henderson, Farabow, Garrett & Dunner

[57] ABSTRACT

An implement for playing a percussion instrument having a handle and a head. The head having different sound-producing properties at different locations on the head. In particular, the hardness and/or diameter of the head varies relative to the longitudinal axis of the handle, such that the differing sounds dependent on the orientation of the head relative to the longitudinal axis of the handle can be obtained.

8 Claims, 2 Drawing Sheets

DRUMSTICKS

This application is a continuation of application Ser. No. 07/598,827, filed Oct. 19, 1990 abandon which is a continuation of application Ser. No. 07/304,433, filed Jan. 23, 1989 abandon.

This invention relates to drumsticks.

Normal drumsticks have a uniformly round head and a round shaft so that they will produce the same sound when used on a drum irrespective of the orientation in which they are held relative their longitudinal axis. To produce a range of sounds, or mallet spectrum as it is often called, a range of different drumsticks is used. For example, those with a relatively small round, hard head will produce better staccato rhymic sounds; those with a larger, softer round felt or padded head produce better legato or duration in single notes and roll sounds.

A problem which a timpani player, or more generally any percussion instrument player, faces is therefore one of choosing the optimum drumsticks to play a passage containing a range of notes such as notes of differing duration, roll notes and staccato notes since he may not have the opportunity to change drumsticks in mid-passage. For example, he may have to try to produce the best staccato he can with a soft head or the best roll he can with a hard head or choose a medium head and get perfection for neither. To the best of my knowledge, this is a problem which has confronted all timpani players since the development of the orchestra. Also this is not just a problem with the timpani but in the playing of any percussion instrument.

The invention has therefore been made with these points in mind and it is an object of the invention to provide a drumstick which is capable of giving a range of duration and timbre.

According to one aspect of the invention, an implement for playing a percussion instrument having a handle and a head at one end of the handle, the head having differing sound-producing properties at different locations on the head, wherein the head is divided into a plurality of segments arranged relative the longitudinal axis of the handle, and wherein the segments are arranged in diametrically-opposed pairs of substantially identical shape, and wherein differing pairs are of differing shape.

According to another aspect of the invention, an implement for playing a percussion instrument having a handle and a head at one end of the handle, the head having differing sound-producing properties at different locations on the head, wherein the head is divided into a plurality of identical shaped segments which are symmetrically arranged around the longitudinal axis of the handle, and wherein the hardness of at least two of the head segments differ.

According to a further aspect of the invention, an implement for playing a percussion instrument having a handle and a head at one end of the handle, the head having differing sound-producing properties at different locations on the head, wherein the head is divided into a plurality of segments arranged relative the longitudinal axis of the handle, wherein at least two of the segments are of substantially the same hardness, and wherein the shape of these at least two head segments differ.

The head has differing sound-producing properties at differing orientations around or along the longitudinal axis of the handle. It seems that the sound-producing properties of a drum head depend, inter alia, on the hardness of the head, the diameter of the head and the weight of the head. Therefore in the drumstick according to the invention the hardness of the head and/or the diameter vary relative the longitudinal axis of the handle.

In this way, the head can provide differing sounds dependent upon the orientation of the head relative the longitudinal axis of the handle and the player can change rapidly as between different required sounds by twisting the axis of the handle in some manner so changing the part of the head which contacts the drum face. This twisting can quickly and repeatedly be effected by twisting the handle between the thumb and the fingers or by ulna rotation.

Previously the choice of one type of drumstick has limited the inherent timbre, projection, dynamic range, rhymic and pitch nuance, the ictus of sound and acoustical balance of multiple instruments of the same or different category, choir or band to the qualities inherent in the particular drumstick chosen by the player. However by using drumsticks according to the invention a player can produce from one pair of drumsticks shorter and longer sounds with increased spectrum of timbre, projection, dynamic range, rhymic and pitch nuance, ictus of sound, acoustical balance and contrast of balance.

The change in the properties of the head can be a continuous change around the axis of the handle, e.g. the diameter of the head can progressively increase over a part of the periphery of the head and/or the type or thickness of the material covering a core can progressively change. Alternatively the change can be step-wise from one orientation to another.

According to one embodiment of the invention the head is divided into segments relative the longitudinal axis of the handle. The segments can themselves be arranged in diametrically-opposed pairs of substantially identical hardness but differing pairs will be of differing hardness and/or diameter. There can, for example, be two or three or more diametrically-opposed pairs of segments.

The differences in the hardness and/or diameters of differing parts or segments of the head can be provided by differing materials or coverings of the headcore and or by differing thicknesses, differing types and differing diameters of the covering material for the headcore. In the way one can regulate the surface area of contact of the head and the hardness of the contact.

For example, the headcore can be made of wood, cork, cane, bamboo, aluminium, plastics material, hard rubber or tightly-wound chamois to provide harder regions for producing staccato-like sounds, whilst longer sounds can be provided by covering the headcore by one or more layers which may be of differing thickness of textile material, felt, leather, plastics material and/or chamois.

In order to assist the player in determining the desired orientation of the head relative the drum face, the handle of the drumstick preferably does not have a conventional round cross-section but instead is of a cross-sectional shape corresponding to the head, e.g. for a head having two opposed pairs of segments - 4 segments in total - the cross-section of the handle is preferably rectangular or more desirably square. However when the head is of larger diameter and/or when the head has a continuous change in properties around the axis of the handle, it is possible for the handle to have a cross-section which mirrors the change in properties of the head, e.g. to have a cross-section which is hexagonal. In this way, the player is helped to feel through his hand a positive change in orientation of the handle, and so accordingly the head, when he wishes to change very quickly to use a differing part of the head in the middle of a continuous playing passage.

Suitably, the handle of the drumstick has a cross-section which is not circular.

In order to assist a player in determining the orientation of the head by feel alone, the handle can be provided with strips or regions extending length-wise of the handle which have differing tactile properties.

The invention is applicable to all types of drumsticks, mallets or hammers used in the playing of all types of wood, metal and membrane percussion instruments including drums of all types, chimes and xylophones.

The invention will now be described, by way of example, with reference to the accompanying drawings, in which.

Figure 1:
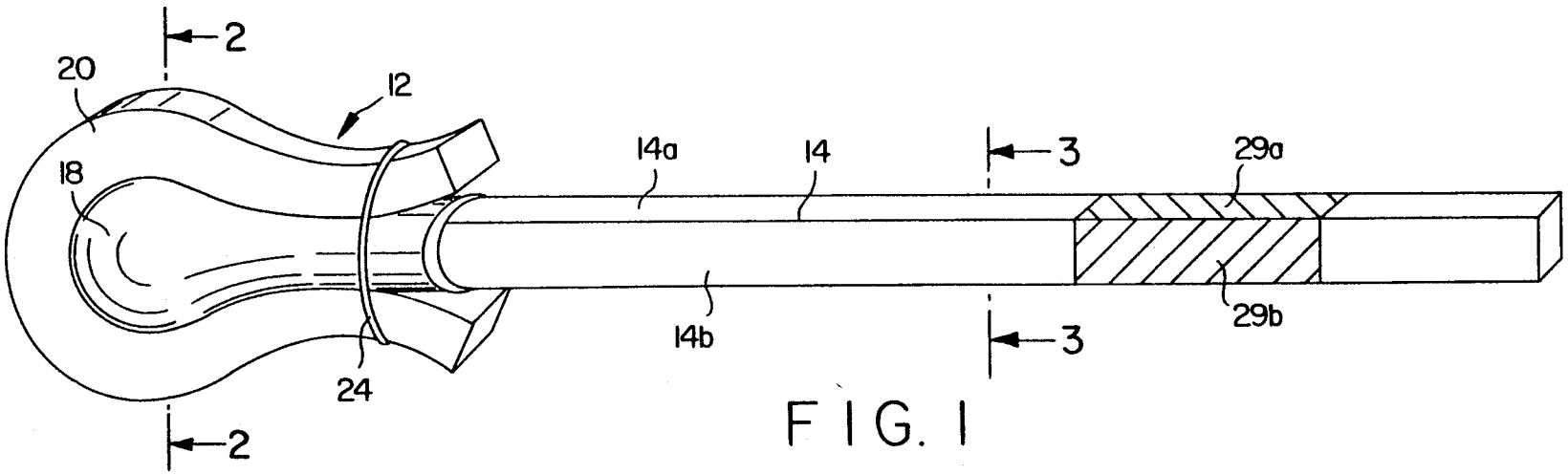
FIG. 1 is an elevation of a first embodiment of drumstick according to the invention.
Figure 3:
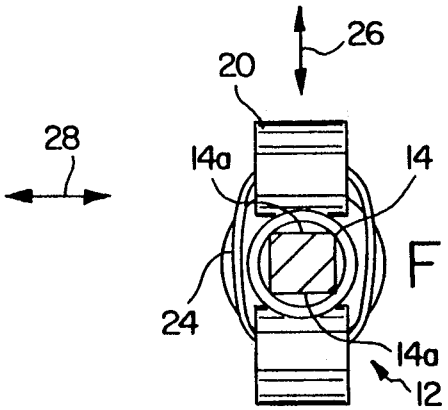
FIG. 3 is a section taken on the line 3—3 of FIG. 1.

A drumstick according to the invention is shown in the drawings. It comprises a head 12 and a shaft or handle 14. The latter is made of wood (i.e., rigid and non-elastic) and, as best shown in FIG. 3, has a square cross-section.

Figure 2:
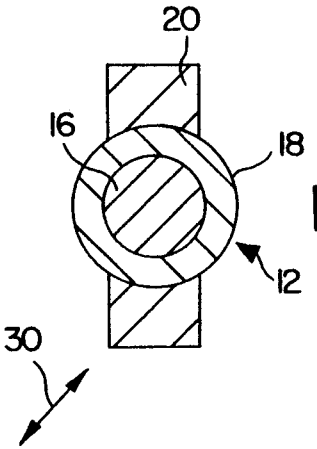
FIG. 2 is a section taken on the line 2—2 of FIG. 1.

Integral with the shaft 14 and within the head is an enlarged wooden headcore 16 (see FIG. 2). This headcore forms the centre of the head 12. It is uniformly covered with a relatively thin layer or pouch of felt, baize or other textile material 18. Then superimposed over that material 18 is a strip 20 of thicker felt. The strip 20 and material 18 are both held in place by a tight tie 24.

The strip 20 is of a width such that, as best shown in FIG. 2, the material 18 extends width-wise to a greater extent than the strip 20 extends in the same width-wise sense. Also the strip 20 is orientated such that it is aligned with and mirrors opposed pairs of flat faces of the square shaped shaft 14, i.e. the faces **14*a*** as shown in FIG. 3.

In order to assist in maintaining the strip 20 in the correct orientation, it may be sewn along its edges, stuck or otherwise joined to the material 18.

The drumstick can therefore be used in one of two orientations. Thus when a drum face is hit with the strip 20. i.e. by moving the head in the direction of the arrow 26 (FIG. 3), a relatively long, more legato sound can be given, yet if the player twists the shaft 14 through 90° and so hits the drum face with the material 18, i.e. by moving the head in the direction of the arrow 28 (FIG. 3), a relatively short, more staccato sound will result. As can be appreciated, this change in orientation can be effected very quickly and during the playing of a continuous passage. In order to distinguish to a player via touching of his fingers which face of the shaft is being held, strips 29 or regions extending length-wise of the handle 14 are provided having different tactile properties. For example, a rough strip **29*a* may be provided on face 14*a* to indicate potential striking of an instrument with material 18, while a smooth strip 29*b* may be provided on face 14*b* to indicate potential striking of an instrument with headcore 16**.

In addition some unique sounds can also be produced by using an edge rather than the flat strip, i.e. by hitting a drum from the direction of the arrow 30 (FIG. 2).

The exact choice of material 18 and strip 20 can be varied widely to give a range of drumsticks with a range of differing possibilities depending upon the nature of the material 18 and of the material of the strip 20. Thus, one or more layers of material can comprise the material 18 and strip 20. Also, the material 18 could be omitted altogether and the wooden core 16 used in the orientation of the arrow 28 to provide precise staccato sounds.

Further the material of the strip 20 need not be of a constant thickness but could vary in a direction around the longitudinal axis of the handle rather like the hammer of a piano has a head of felt of varying thickness.

An important advantage of the invention is that entirely conventional materials used currently in drumstick manufacturing can be used in the construction of the drumstick, i.e. the wooden shaft 14 and headcore 16, and the material 18 and material of the strip 20. Also, the fabrication of the drumstick can be relatively straightforward.

Figure 4:
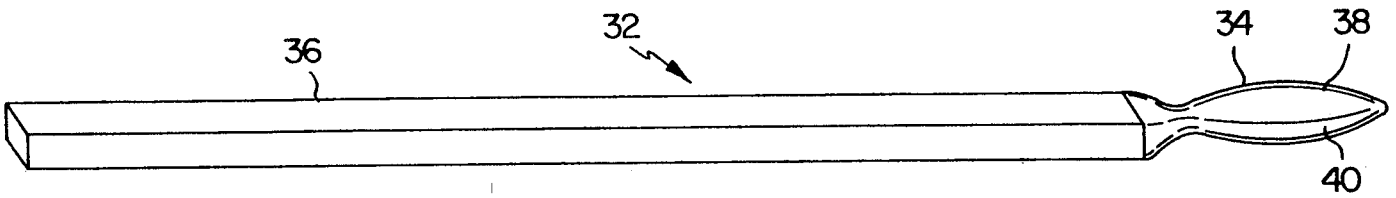
FIG. 4 is an elevation of a second embodiment of drumstick according to the invention.

In FIG. 4, a drumstick 32 is shown having a head 34 and handle 36, the head 34 being formed from two separate half segments 38 and 40 made from different materials. For example, the segment 38 could be made from wood, while the segment 40 could be made from either plastics or metal, and even though the segments 38 and 40 have an identical shape, the head 34 provides differing sound-producing properties at differing orientations around the head, due to the differing materials used for the segments 38 and 40.

Figure 5:
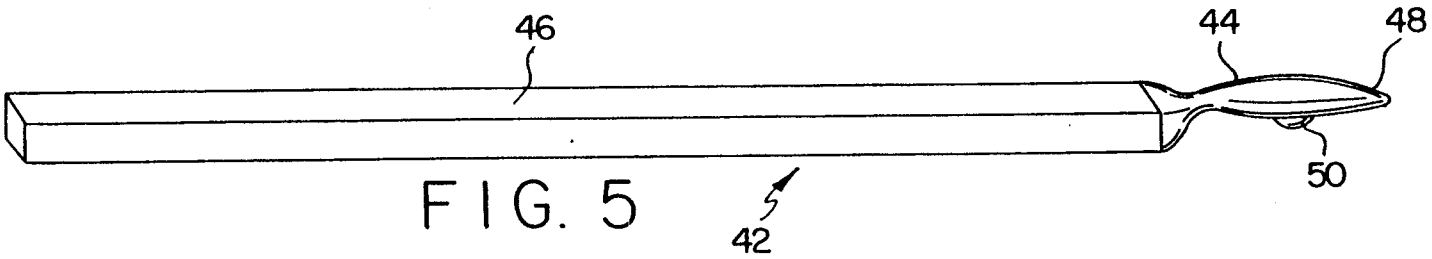
FIG. 5 is an elevation of a third embodiment of drumstick according to the invention.

In FIG. 5 meanwhile, a drumstick 42 is shown having a head 44 and handle 46, the head 44 being formed from two separate half segments 48 and 50 of identical material (such as wood, plastics, metal or nylon), but differing size and diameter in order to provide differing sound-producing properties at differing orientations around the head, due to differing diameters of the segments 48 and 50.

Figure 6:
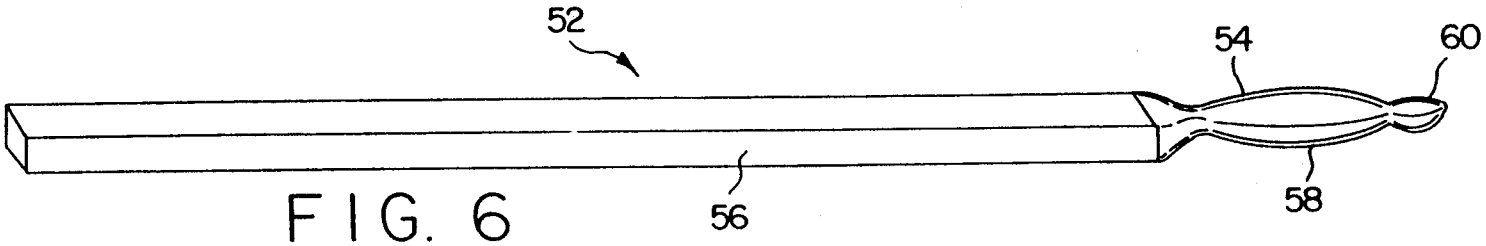
FIG. 6 is an elevation of a fourth embodiment of drumstick according to the invention.

Finally, in FIG. 6 a drumstick 52 is shown having a head 54 and handle 56, the head 54 having two full segments 58 and 60 of identical material but differing size and diameter, the smaller segment 60 being provided at the outer end of the larger segment 58 in order to provide differing sound-producing properties at differing orientations along the head, due to the differing diameters of the segments 58 and 60.

I claim:

1. An implement for playing a percussion instrument comprising a rigid handle having a longitudinal axis; and a head at one end of said handle, said head being divided into a plurality of segments that extend in an axial direction relative to the longitudinal axis of said handle, said segments having at least two different outer shapes, being made of at least two different substances and having at least two different sound-producing properties, said segments being arranged around said longitudinal axis to form at least two diametrically opposed pairs of segments, the segments in each of said pairs being of identical outer shape, substance and sound-producing property.

2. The implement of claim 1, wherein the head has a diameter that varies around the longitudinal axis of the handle.

3. The implement of claim 2 comprising two pairs of segments.

4. The implement of claim 3, wherein said head has a core that is partially covered with a layer of material at two diametrically opposed locations to provide said two pairs of segments.

5. The implement of claim 4, wherein said layer of material extends longitudinally and continuously over and along a first side of said core of said head toward an end of said head opposite from said handle, over said head end and back along a second side of said core of said head that is diametrically opposed from said first side.

6. The implement of claim 1, which is a drumstick.

7. An implement for playing a percussion instrument comprising a handle having a longitudinal axis; and a head at one end of said handle, said head being divided into two identically shaped segments that extend in an axial direction relative to and are arranged symmetrically around the longitudinal axis of said handle, each of said segments comprising one-half of said head, said segments being made of different substances that have different sound-producing properties.

8. The implement of claim 7, which is a drumstick.

* * * * *